US008537072B2

(12) United States Patent
Jensen et al.

(10) Patent No.: US 8,537,072 B2
(45) Date of Patent: Sep. 17, 2013

(54) ANTENNA FOR MOBILE TERMINAL UNIT

(75) Inventors: Martin Jensen, Staffanstorp (SE); Carl-Gustaf Blom, Lysekil (SE)

(73) Assignee: Lite-On Mobile Oyj, Vantaa (FI)

( * ) Notice: Subject to any disclaimer, the term of this patent is extended or adjusted under 35 U.S.C. 154(b) by 434 days.

(21) Appl. No.: 12/444,814

(22) PCT Filed: Dec. 6, 2007

(86) PCT No.: PCT/SE2007/050949

§ 371 (c)(1),
(2), (4) Date: Apr. 8, 2009

(87) PCT Pub. No.: WO2008/069750

PCT Pub. Date: Jun. 12, 2008

(65) Prior Publication Data

US 2010/0090922 A1 Apr. 15, 2010

(30) Foreign Application Priority Data

Dec. 8, 2006 (SE) ..... 0602632

(51) Int. Cl.
*H01Q 1/42* (2006.01)
*H01Q 1/40* (2006.01)
*H01Q 1/24* (2006.01)

(52) U.S. Cl.
USPC ..... 343/873; 343/872; 343/702

(58) Field of Classification Search
USPC ..... 343/872, 873, 702
See application file for complete search history.

(56) References Cited

U.S. PATENT DOCUMENTS

| | | | | |
|---|---|---|---|---|
| 6,285,324 | B1 * | 9/2001 | Korisch et al. | 343/700 MS |
| 6,396,444 | B1 * | 5/2002 | Goward et al. | 343/702 |
| 6,642,907 | B2 * | 11/2003 | Hamada et al. | 343/873 |
| 7,271,769 | B2 * | 9/2007 | Asano et al. | 343/702 |
| 7,391,378 | B2 | 6/2008 | Mikkola et al. | |
| 7,518,553 | B2 * | 4/2009 | Zhang et al. | 343/700 MS |
| 7,548,206 | B2 * | 6/2009 | Hong | 343/700 MS |
| 7,940,220 | B2 * | 5/2011 | Jeon et al. | 343/702 |
| 7,973,727 | B2 * | 7/2011 | An et al. | 343/702 |
| 7,973,734 | B2 * | 7/2011 | Strempel et al. | 343/873 |
| 8,068,067 | B2 * | 11/2011 | Hong et al. | 343/873 |
| 8,111,201 | B2 * | 2/2012 | Tsujimura et al. | 343/702 |
| 8,120,539 | B2 * | 2/2012 | Hong et al. | 343/702 |
| 8,130,170 | B2 * | 3/2012 | Nakahata et al. | 343/906 |

(Continued)

FOREIGN PATENT DOCUMENTS

| | | |
|---|---|---|
| EP | 1 085 597 | 3/2001 |
| EP | 1 225 652 | 7/2002 |

(Continued)

OTHER PUBLICATIONS

International Search Report of corresponding PCT/SE2007/050949 mailed Feb. 29, 2008.

(Continued)

*Primary Examiner* — Douglas W Owens
*Assistant Examiner* — Jennifer F Hu
(74) *Attorney, Agent, or Firm* — Alston & Bird LLP

(57) ABSTRACT

An antenna (201) is provided comprising at least one antenna radiator (201) molded with a non-conductive cover (203) of a mobile terminal unit. The connection to electronic circuits of the mobile terminal unit is made non-galvanic through dielectric interfaces (209) being integrated in the cover.

14 Claims, 3 Drawing Sheets

(56) References Cited

U.S. PATENT DOCUMENTS

| | | | | |
|---|---|---|---|---|
| 8,232,919 | B2 * | 7/2012 | Rofougaran | 343/700 MS |
| 8,248,310 | B2 * | 8/2012 | Hung et al. | 343/702 |
| 8,289,216 | B2 * | 10/2012 | Cho et al. | 343/702 |
| 8,387,232 | B2 * | 3/2013 | Hong et al. | 29/600 |
| 8,400,361 | B2 * | 3/2013 | Rofougaran | 343/700 MS |
| 2005/0001767 | A1 * | 1/2005 | Wulff et al. | 343/700 MS |
| 2005/0001775 | A1 * | 1/2005 | Liang et al. | 343/702 |
| 2006/0119519 | A1 | 6/2006 | Kwon | |

FOREIGN PATENT DOCUMENTS

| | | |
|---|---|---|
| EP | 1439603 | 7/2004 |
| EP | 1667282 | 6/2006 |
| EP | 2 102 938 | 9/2009 |
| WO | WO 2007/040431 | 4/2007 |
| WO | WO 2011/051408 | 5/2011 |
| WO | WO 2011/076582 | 6/2011 |

OTHER PUBLICATIONS

Office Action of corresponding European Appl. No. 07852221.6 mailed Apr. 9, 2010.

Extended European Search Report of corresponding European Appl. No. 07852221.6 dated Jan. 4, 2010.

Preliminary Report of Patentablility dated Jun. 10, 2009, for PCT Application No. PCT/SE2007/050949.

Applicant's Response dated Jun. 22, 2010, to Office Action dated Apr. 9, 2010 for European Application No. 07852221.6.

Communication from European Patent Office dated Aug. 8, 2011, regarding withdrawal of Application No. 07852221.6.

* cited by examiner

ANTENNA FOR MOBILE TERMINAL UNIT

TECHNICAL FIELD

The present invention relates to an antenna for a mobile terminal unit, such as a mobile telephone, comprising electronic circuits and at least one antenna radiator molded with a non conductive cover of the mobile terminal unit and a connection between the circuits and the at least one antenna radiator. The antenna is intended for operation in one or several frequency bands. The invention also includes a mobile terminal comprising such an antenna.

BACKGROUND ART

Several types of antennas intended for integration in mobile terminals are available today. The most common type is the so-called PIFA (Planar Inverted F Antenna) antenna. These antennas normally consist of a radiator element made of metal sheet or flex-film applied to a plastic carrier mounted at a certain distance above ground. Other types exist, all having in common that they are integrated inside the covers of the phone and taking up valuable space.

In mobile terminals of today there is a requirement for more compact terminals and above all thinner terminals which is of special interest for mobile terminals such as mobile phones.

Solutions to integrate the radiating elements of the terminal in the outer cover have therefore been proposed. In this way the number of components is reduced and the thickness of the cover can be used to separate the radiator from the ground as far as possible which is positive for a good antenna performance. This also makes it possible to reduce the thickness of the phone as the cover, including the radiator, becomes part of the antenna. This means that no space is required inside the cover for the radiator as is the case with conventional solutions, thus making the phone thinner.

EP 1439603 proposes a solution with an antenna radiator integrated in a cover and fed through a special feeding element.

A problem with integrating the antenna radiator in the cover in prior art solutions is that it will become more sensitive to influences from the hand of the user of the mobile terminal. Both the signal strength and frequency of the antenna will be affected when the hand covers the antenna or part of the antenna causing a reduced coverage area for the antenna, and possibly a dropped call, as well as reduced talk time as the terminal has to increase output power to compensate for the decreased antenna performance.

Thus there is a requirement for an improved antenna performance where the antenna radiator is integrated in the cover to a mobile phone.

DISCLOSURE OF INVENTION

An object with the present invention is to provide an antenna that can be integrated in the cover of a mobile terminal unit, henceforth exemplified with a mobile phone, that eliminates the drawbacks with prior art and to accomplish a solution with very compact outer dimensions with easy and cost effective manufacturing.

To take advantage of the relatively large area of a cover to a mobile phone several antennas can be integrated in the cover such as GSM, TV and FM antennas or separate antennas for receiving and transmitting thus reducing the number of components even further making the assembly efficient and cost effective.

These objects are met by providing an antenna for a mobile terminal unit comprising radio frequency circuits and at least one antenna radiator molded with a non-conductive cover of the mobile terminal unit and a connection between the radio frequency circuits and the at least one antenna radiator where the connection between the radio frequency circuits of the mobile terminal unit and the antenna radiator is made non-galvanic through at least one dielectric interface being integrated with the cover.

By using the dielectric interfaces having a relatively high dielectric constant, preferably around 20, the antenna will be less sensitive to affects from a hand holding the mobile phone and covering, or partly covering, the antenna. However higher values for the dielectric constant can be used as well as lower values down to at least 10. The sensitivity will be decreased in relation to the difference in dielectric constant between the hand and the dielectric interface.

A further advantage with the present invention is the possibility of improved matching, i.e. to adjust the impedance of the antenna to the impedance of the RF-circuits of the mobile phone. Good matching means that transmission losses between the RF-circuits and the antenna are minimized. The invention allows the matching to be performed by adjusting different parameters of the dielectric interface as will be described in detail below. This eliminates the need to perform matching with discrete components.

The antenna radiator included in the cover can be of ground dependent or ground independent type. A ground dependant antenna interacts with a ground plane in the mobile phone, usually one of the layers in a multilayer Printed Circuit Board (PCB) comprising electronic components of the mobile phone. The ground independent type of antenna can work without the interaction of a ground plane.

The antenna is preferably integrated in the outer rear cover of a mobile phone. However integration can also be performed in an internal non-conductive cover or in any suitable non conductive part of the mobile phone.

The invention also includes a mobile terminal comprising the antenna according to claim 1.

Further advantages are achieved if the invention also is given one or several characteristics according to the dependent claims not mentioned above.

BRIEF DESCRIPTION OF DRAWINGS

The invention will now be described in more detail with reference to the enclosed drawings where.

EMBODIMENT(S) OF THE INVENTION

The invention will in the following be described in detail with reference to the drawings.

Figure 1:
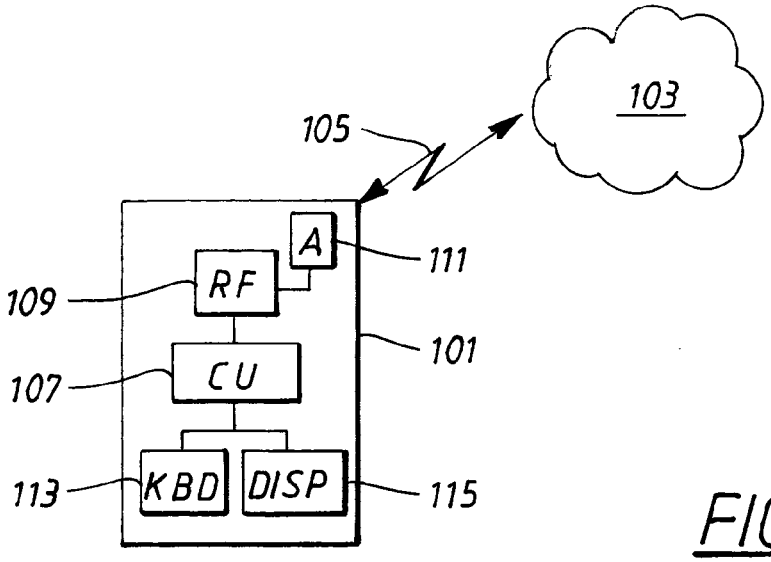
FIG. 1 shows schematically a mobile phone comprising an antenna according to the present invention.

FIG. 1 shows a mobile phone 101 comprising a control unit 107 configured to control communication with a mobile communication system 103. A keyboard 113, a display 115 and radio frequency (RF) circuits 109 are connected to the control unit 107 which together with an antenna 111 are arranged to establish a radio-interface 105 for communication with the mobile communication system 103.

Figure 2:
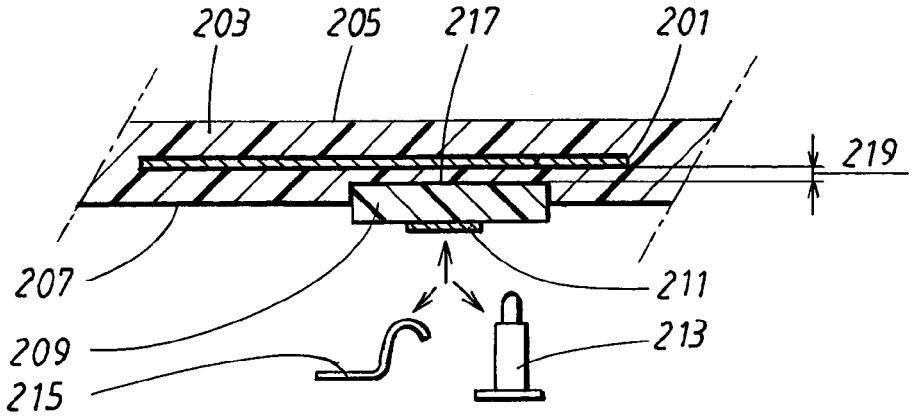
FIG. 2 is a cross cut of the cover showing radiating element and Dielectric Interface (DI) molded to the cover.

FIG. 2 shows the radiator 201 embedded in the rear cover 203. The cover can be the rear non-conductive cover of a mobile phone, an internal non-conductive cover or an internal non-conductive component such as a plastic carrier for a speaker. In the case of a clam shell type of phone the radiator is preferably embedded in the rear top or bottom cover.

The radiator can be embedded in the cover using IMF (In Mould Foil), IMD (In Mold Decoration) or IML (In Mold Label) technology. The radiator can be placed close to the outer surface 205 of the cover or the inner surface 207. When the radiator is placed at the surface 205, a protective film may be applied to the exterior surface prior to the molding process, or subsequently.

The radiator 201 can be curved in two or three directions and shaped as to follow the shape of the cover 203. The radiator can be any type of RF-suitable, conductive material as known by the person skilled in the art. Preferably a copper foil with a thickness of 5 μm or thicker is used. A flex film including the radiator pattern can also be used. When using IML technology, the label being the radiator, can be pre shaped to the desired form.

A DI (Dielectric Interface) 209, located in a groove in the cover 203, is molded to the cover 203 after the in-mold of the radiator 201. Alternatively it can be included in any of the in-mold processes mentioned above. Any other conventional methods, as e.g. gluing, can be used to attach the DI 209 to the cover 203. DI has conductive pads 211 for contact with the RF circuits 109. The contact can be established with any conventional method such as a pogo-pin 213 or a contact pin 215. These contact elements 213 and 215 are attached to either a pad on a Printed Circuit Board (PCB) holding the RF-circuits 109 or to the conductive pad 211 of the DI. The attachment can be made in any conventional way as e.g. by soldering so as to establish a galvanic contact between the DI and RF-circuits 109. The DI is manufactured of a dielectric material with a relatively high dielectric constant, preferably around 20, but higher and lower values down to at least 10 can also be used. The DI can be realized as blocks or pucks of dielectric material having a conductive pad 211. One embodiment of DI is a ceramic resonator such as e.g. a coaxial resonator well known to the skilled person. The top surface 217 of DI is in a preferred embodiment substantially parallel to the radiator 201.

The distance of the gap 219 can be varied in order to obtain a good impedance match between the radiator and RF circuits 109. The impedance matching can also be tuned by using different ∈-values for DI and by changing the surface area DI is facing towards the radiator 201. The invention thus provides several parameters for tuning the impedance such as; the ∈-value, gap distance and surface area of DI facing the radiator. This makes it possible to obtain good matching and avoiding the need to use discrete electronic components in the RF-circuit 109.

The radiator 201 in FIG. 2 is a single radiator with a RF-feed realized through the DI 209. The radiator in this case can be a monopole antenna not requiring a ground plane for its operation or any other type of ground independent antenna type.

Figure 3:
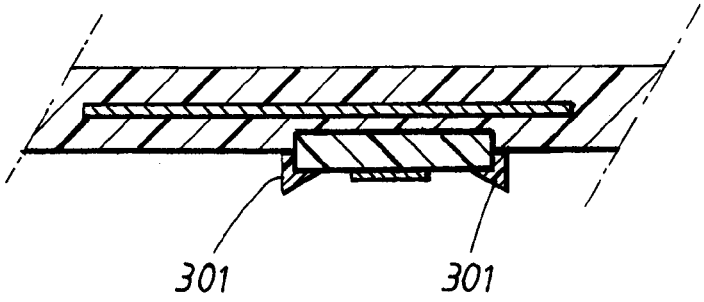
FIG. 3 is a cross cut of the cover showing radiating element and Dielectric Interface (DI) snapped to the cover.

FIG. 3 differs from FIG. 2 only in the way the DI is attached to the cover. In this embodiment the DI is attached by snapping it onto the cover using hatches 301 or some other snapping means well known to the skilled person.

Figure 4:
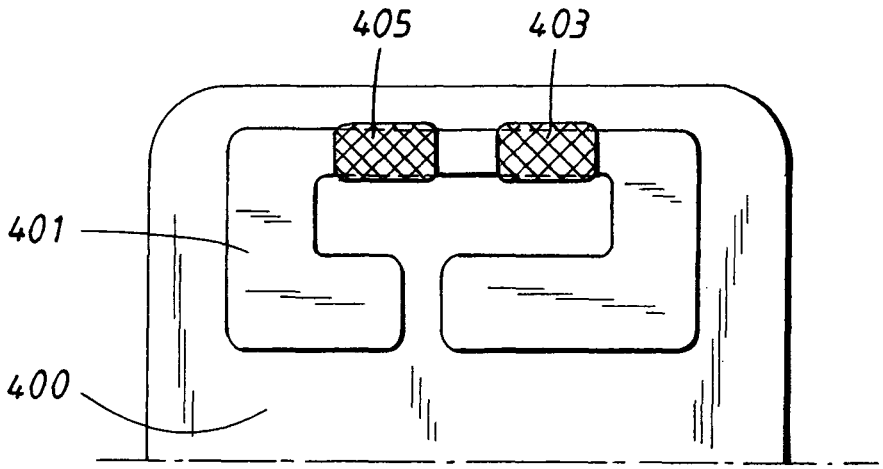
FIG. 4 is a schematic top view of one embodiment of the invention showing a conventional PIFA-type of multiband antenna structure with Dielectric Interfaces for RF and ground embedded in a rear cover to a mobile phone.

FIG. 4 is a top view of a radiator 401 molded with a cover 400. In this case the radiator has a typical PIFA configuration with two branches seen from the grounding point. This makes it possible to have two resonances, one for each branch, and thus accomplishing a dual band antenna. This antenna type requires the cooperation of a ground plane. In a mobile phone the ground plane of the PCB can be used. Connection to the ground plane is accomplished by a DI 405 designed in the same way as the DI 209 described above. The gap distance for the DI 405 to the radiator 401 is typically around 0.1 mm in order to create a sufficient coupling at the lowest operating frequencies between radiator and ground. The RF-feed is accomplished with DI 403 in the same way as described for FIG. 2 above. The in-molding of the radiator and attachment of the two DI are realized in the same way as described above. In this way a separate unit comprising cover, antenna, impedance matching through DI and contact pads to the RF-part of the mobile phone is accomplished.

In an embodiment with a flex film as the radiating element the DI can be mounted flush to the bottom surface of the flex film substrate and the flex film substrate then becomes the dielectric material between the DI and the radiator which is applied on the top surface of the flex film substrate.

By using a DI interfaces having a dielectric constant preferably around 20, but also higher and lower values down to at least 10 can be used, an "insulation" between a hand holding the phone and covering part of, or the whole radiator, embedded in the cover and the RF and ground parts in the phone is realized. In a conventional solution the hand will affect the antenna performance in a negative way. The amplitude of received or transmitted signals will be reduced and the frequency response for the antenna will be shifted, both effects giving decreased antenna performance. These negative effects will be much reduced by introducing the "insulation" through DI and the high dielectric constant.

Another embodiment not shown in the figures is that the two DI 403 and 405 can be put on a common substrate like a PCB or the PCB itself constitutes the dielectric material and is divided into as many DI units as required, each DI having a conductive pad for contacting the RF-circuits 109.

Figure 5:
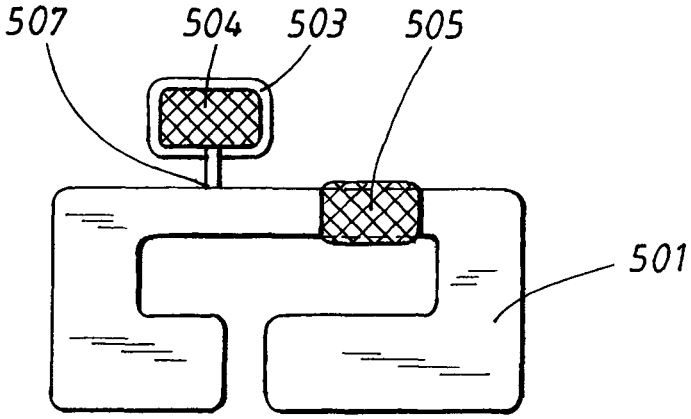
FIG. 5 is a schematic top view of an antenna radiator of PIFA-type structure with Dielectric Interfaces for RF and ground.

FIG. 5 is a top view of an antenna comprising one radiator 501 with PIFA configuration and a separate ground connection part 503. The DI 504 for the ground feed is located above ground connection part 503. The RF-feed is handled by DI 505. In this way there will be a well-defined grounding point 507 of the PIFA with the possibility to locate the ground feed at a convenient position "off" the PIFA location.

Figure 6:
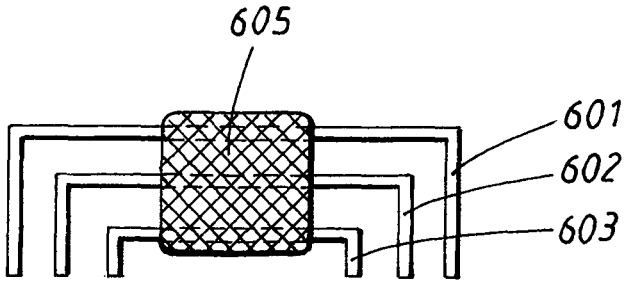
FIG. 6 is a schematic top view of an antenna radiator with three half wave resonant, ground independent elements, fed by a common Dielectric Element.

FIG. 6 is a top view of another embodiment where the antenna consists of three radiator elements, 601, 602 and 603. Each element is half wave resonant with different resonance frequencies as the length is different for each element. The elements are fed by a common DI 605 located approximately in the centre of each element. A halfway resonant antenna is not dependent on the cooperation of a ground plane and a ground feed is therefore not required in this embodiment. A half wave resonant antenna has an electrical length that is a half wavelength of the resonant frequency of the antenna as is well known to the person skilled in the art.

Figure 7:
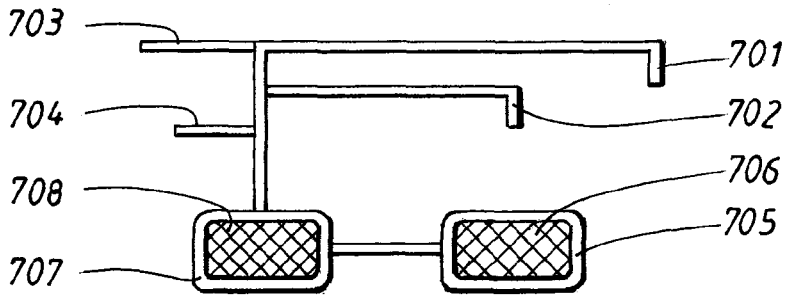
FIG. 7 is a schematic top view of an antenna radiator with a "treestructure" of quarter wave elements with different resonances.

FIG. 7 is a top view of a radiator comprising a "treestructure" of quarter wavelength elements 701, 702, 703 and 704, having an electrical length corresponding to a quarter of the wavelength of the resonant frequency. This type of radiator is ground dependent and thus requires a ground feed. A ground feed pad 705 is therefore included in the radiator pattern as well as a RF-feed pad 707. The feeding is provided with DI 706 for ground and DI 708 for RF. The separate feeding pads ensures efficient electromagnetic coupling between RF-feed and ground in the mobile phone and the antenna. The pads can also be located at positions convenient for matching suitable feeding points in the mobile phone.

Figure 8:
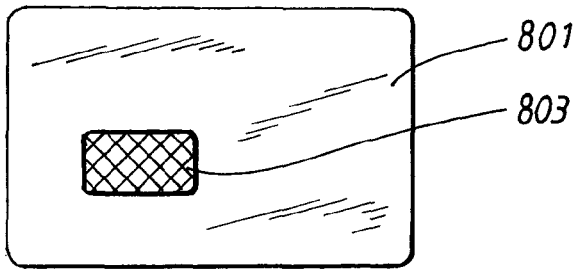
FIG. 8 is a schematic top view of an antenna radiator comprising a patch element.

Another embodiment of the radiator is shown in FIG. 8. It is a top view of a patch radiator 801 fed a certain point through the DI 803. The patch radiator has to cooperate with a ground plane, which in this case can be the ground plane of the PCB of the mobile phone, but does not need a separate ground feed. The patch can be designed to be single or multi resonant as is well known in the art. The feeding location is chosen as to achieve a good impedance match.

Figure 9:
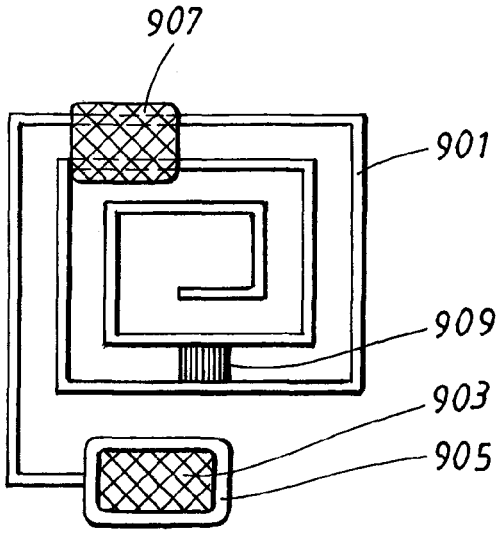
FIG. 9 is a schematic top view of an antenna radiator with a double resonant coil structure.

FIG. 9 is yet another embodiment of a dual resonant coil type of radiator element seen from the top. The radiator has a coil 901 with ground feed pad 905 and shortcircuiting part or short 909. The short is effective for higher frequencies and thus makes the coil length shorter for these frequencies. For lower frequencies the short is not working and the electrical length for lower frequencies will correspond to the total coil length. The ground feed is made through DI 903 and the RF-feed through DI 907. This accomplishes an efficient and compact dual resonant antenna.

Mobile phones of today often require several antennas for different functions of the phone as e.g TV, FM-radio, GPS, Bluetooth. Sometimes it is also required to have separate receiving and transmitting antennas. As the invention makes it possible to use a large surface for antennas, e.g the complete back cover of the mobile phone it will be possible to integrate several antennas in the cover as for instance a GSM and TV-antenna.

The embodiments described above are only possible examples of how to realize the invention and should not be limiting. Over and above the embodiments described above it is of course possible within the scope of the invention to include any suitable radiating element, either ground dependent or ground independent. It is also a possibility to include separate parasitic elements that are fed from a main radiator only.

The invention claimed is:

1. An antenna for a mobile terminal unit comprising:

radio frequency circuits;

a non-conductive cover of the mobile terminal unit;

at least one antenna radiator molded with the non-conductive cover, such that the at least one antenna radiator is embedded in the non-conductive cover; and at least one connection between the radio frequency circuits and the at least one antenna radiator, wherein the at least one connection between the radio frequency circuits of the mobile terminal unit and the at least one antenna radiator is made non-galvanic through at least one dielectric interface being attached to the non-conductive cover, thus forming a consolidated unit comprising the non-conductive cover, the at least one antenna radiator, and the at least one dielectric interface, said consolidated unit being separate and distinct from the radio frequency circuits.

2. An antenna according to claim 1, wherein at least one of the antenna radiators is a ground dependent antenna cooperating with a ground plane.

3. An antenna according to claim 2, wherein the at least one ground dependent antenna radiator is connected to ground through at least one ground Dielectric Interface and to RF through at least one RF Dielectric Interface.

4. An antenna according to claim 1, wherein at least one of the antenna radiators is a non-ground dependent antenna not requiring cooperation with a ground plane.

5. An antenna according to claim 1, wherein the cover is the external cover of the mobile terminal unit.

6. An antenna according to claim 1, wherein the cover is an internal cover of the mobile terminal unit.

7. An antenna according to claim 1, wherein the cover is an internal non conductive component of the mobile terminal unit.

8. An antenna according to claim 1, wherein the at least one Dielectric Interface comprises a dielectric unit with conductive pads metalized on part of the side or the complete side facing away from the cover for connection to the RF-circuits of the mobile terminal unit and attached to the cover by molding.

9. An antenna according to claim 1, wherein the at least one Dielectric Interface comprises a dielectric unit with conductive pads metalized on the side facing away from the cover for connection to the RF-circuits of the mobile terminal unit and attached to the cover by a snapping arrangement.

10. An antenna according to claim 3, wherein the at least one RF Dielectric Interface and the at least one ground Dielectric Interface are integrated in or on a common dielectric substrate.

11. An antenna according to claim 1 further comprising more than one antenna radiator embedded, each with separate Dielectric Interfaces and configured for different frequency bands.

12. An antenna according to claim 1 further comprising a separate antenna radiator for transmitting antenna and receiving antenna, each with its own Dielectric Interfaces.

13. An antenna according to claim 1, wherein the at least one antenna radiator is integrated in the rear cover of the mobile terminal unit.

14. An antenna according to claim 1, wherein the antenna is disposed on the mobile terminal unit.

* * * * *